United States Patent [19]

Fukumoto

[11] Patent Number: 4,864,746

[45] Date of Patent: Sep. 12, 1989

[54] APPARATUS FOR COMPENSATING STOP POSITION OF BUCKET

[75] Inventor: Takefumi Fukumoto, Sayama, Japan

[73] Assignee: Kabushiki Kaisha Komatsu Seisakusho, Tokyo, Japan

[21] Appl. No.: 261,834

[22] PCT Filed: Jan. 29, 1988

[86] PCT No.: PCT/JP88/00083

§ 371 Date: Sep. 23, 1988

§ 102(e) Date: Sep. 23, 1988

[87] PCT Pub. No.: WO88/05846

PCT Pub. Date: Aug. 11, 1988

[30] Foreign Application Priority Data

Jan. 29, 1987 [JP] Japan ..... 62-019532

[51] Int. Cl.[4] ..... E02F 5/00

[52] U.S. Cl. ..... 37/103; 37/108 R; 37/DIG. 20

[58] Field of Search ..... 37/103, 108 R, 108 A, 37/117.5, DIG. 20; 414/685, 699; 172/3, 4.5

[56] References Cited

U.S. PATENT DOCUMENTS 3,712,404 1/1973 Walquist ..... 37/DIG. 20
3,786,871 1/1974 Long et al. ..... 172/4.5
4,045,893 9/1977 Feinzilber ..... 37/108 R
4,081,033 3/1978 Bulger et al. ..... 172/4.5

FOREIGN PATENT DOCUMENTS 420732 8/1974 U.S.S.R. ..... 37/DIG. 20
592936 2/1978 U.S.S.R. ..... 37/DIG. 20

*Primary Examiner*—Eugene H. Eickholt
*Attorney, Agent, or Firm*—Frost & Jacobs

[57] ABSTRACT

In order to lessen the operator's fatigue and improve his actions in accuracy, there is provided an apparatus of the present invention for compensating a stop position of a bucket of a loader. By the use of the apparatus, it is possible to automatically compensate the stop position of the bucket so as to keep the bucket substantially horizontal even when the engine speed varies. The apparatus of the present invention is provided with: a detecting element (67 or 67') for detecting the extending/retracting speed of a bucket cylinder unit (27) of the loader; and a controller (51) in which a necessary time lag (Bi) is established on the basis of a signal issued from the detecting element, and after collapse of a period of such time lag, a relay (66) for energizing a leveler solenoid (46) is turned on and kept "on" until a limit switch (33) for limiting the extension of the bucket cylinder unit (27) is turned off.

2 Claims, 4 Drawing Sheets

APPARATUS FOR COMPENSATING STOP POSITION OF BUCKET

FIELD OF THE INVENTION

The present invention relates to an apparatus for compensating a stop position of a bucket of a loader such as a tractor shovel and the like, and more particularly to an apparatus for compensating a stop position of a bucket in a bucket leveler device for the loader such as the tractor shovel and the like, through which apparatus the stop position of the bucket of the loader is automatically compensated so that the bucket is kept substantially horizontal even when an engine of the tractor shovel and the like is operated in any condition (or at any engine speed).

BACKGROUND OF THE INVENTION

In loading operation of the loader such as the tractor shovel and the like, the earth and sand are loaded into a dump trucks, hoppers and the like. Namely, the earth and sand shoveled by a bucket of such loader are discharged into the dump truck, hopper and the like. In case that the loader is a tractr shovel, after completion of discharging of the earth and sand, an operator of the tractor shovel backs the tractor shovel. At this time, in order to efficiently perform shoveling of the earth and sand in a minimum of time in the next cycle, the operator moves a boom of the tractor shovel downward, while he so changes the direction of the bucket that the bucket having been tilted downward for discharging the earth and sand is tilted back to be kept horizontal so as to facilitate the shoveling operation of the bucket conducted along the ground in the next cycle.

Namely, after completion of discharging of the earth and sand, the operator must confirm a rearward safety of the tractor shovel when he backs the tractor shovel. In addition to such confirmation of the rearward safety of the tractor shovel, the operator must confirm a frontward safety of the tractor shovel in an operation in which the bucket is tilted back to be kept horizontal at a time when the bucket is brought into contact with the ground. Consequently, at this time, the operator of the tractor shovel must perform simultaneously a plurality of actions such as: a steering action of the tractor shovel; controlling actions of levers for lowering a boom; and controlling actions for stopping a tilting operation of the bucket so as to keep the bucket horizontal. Therefore, the operator of the tractor shovel must be a skilled one. In addition, in the above tilting operation of the bucket, since the bucket is tilted back to be kept horizontal through visual observation of the operator, the horizontal position of the bucket varies in each cycle to make an operational accuracy of the shoveling of the bucket poor. This is disadvantageous to the tractor shovel.

As is already well known, in order to eliminate such disadvantage, a bucket leveler device has been employed in the tractor shovel.

Such conventional bucket leveler device is constructed of: a signal issuring portion "A" shown in FIGS. 1 and 2 of the accompanying drawings; and a bucket control lever return mechanism portion "B" shown in FIG. 1.

As shown in FIGS. 1 and 2, in the signal issuing portion "A" of the bucket leveler device: a limit switch 33 is mounted on a side portion of a cylinder 31 of a bucket cylinder unit 27 for controlling the position of a bucket 23 with respect to a boom 22; and a position detecting element 34 is so mounted on a piston rod 29 of the bucket cylinder unit 27 as to turn on the limit switch 33 at a time when the bucket cylinder unit 27 is extended by a predetermined length, whereby the limit switch 33 having been turned on issues a signal.

On the other hand, as shown in FIGS. 1 and 3, in the bucket control lever return mechanism portion "B" of the bucket leveler device a guide plate 44 is mounted on a bucket control lever 43. The bucket control lever return mechanism portion "B" is also provided with a lever detent mechanism "C" in which: a roller 50 is pressed against the guide plate 44 under the influence of a resilient force exerted by a tension spring 49; the guide plate 44 in its contour and the tension spring 49 in its stiffness are so determined as to make it possible to hold the bucket control lever 43 at its full-stroke position after the bucket control lever 43 is moved to such full-stroke position thereof. In the bucket control lever return mechanism portion "B" of the bucket leveler device, there is further provided a leveler solenoid 46 for electrically unlocking the lever detent mechanism "C".

In the signal issuing portion "A" of the bucket leveler device, when the bucket cylinder unit 27 is extended by the predetermined length, the limit switch 33 is turned on to issue an electrical signal for energizing the leveler solenoid 46. The thus energized leveler solenoid 46 unlocks the lever detent mechanism "C" to permit a bucket control valve 35 to be moved to its neutral position from a tilt position thereof under the influence of a resilient force exerted by a return spring incorporated in the bucket control valve 35.

Namely, once the operator has moved the bucket control lever 43 to its full stroke position at a time when the operator backs the tractor shovel, it is possible for the operator to permit the bucket 23 to continue its tilting action even if he frees his hand from the bucket control lever 43 thereafter. When the bucket cylinder unit 27 has been extended by the predetermined length for directing the bucket 23 in a horizontal direction in general, the bucket control lever 43 automatically returns to its neutral position to stop the tilting action of the bucket 23.

Consequently, the operator can concentrate his attention on the lowering operation of the boom 22 and the steering operation of the tractor shovel through his hands and on the rearward safety through this eyes. As is clear from the above description, the bucket leveler device is indispensable to the loader such as the tractor shovel and the like.

In a brief summary, the operations of the bucket leveler device in the prior art are as follows: turn on the limit switch 33→ actuate the leverler solenoid 46→ oerate the bucket control lever 43→ actuate the bucket control valve 35→ control the oil pressure in the bucket cylinder unit 27→ and stop the bucket 23. In the above operations of the bucket leveler device, there are slight time lags between the operations. However, these slight time lags amount to a considerable time lag of the order of naught point several seconds in the entire bucket leveler device.

On the other hand, since the delivery of an oil pump in a hydraulic circuit employed in the bucket leveler device depends on the engine speed, an angular velocity of the bucket 23 in its tilting-back action varies as the engine speed varies.

Consequently, the stop position of the bucket 23 varies according to variation of the engine speed, which produces the time lags and variation of the angular velocity of the bucket 23 in its tilting-back action.

Namely, when the engine speed is relatively low, the bucket 23 is held at a high position slightly higher than a desired position. On the other hand, when the engine speed is relatively high, the bucket 23 is held at a position higher than the above high position. As described above, the stop position of the bucket 23 varies when the engine speed varies.

Since the stop position of the bucket 23 varies as described above, shoveling of thin surface layers of products and the soil by the use of the bucket 23 adversely affect the products and the soil. In addition, due to such variation of the stop position of the bucket 23, the cutting edge of the bucket 23 is unevenly worn to cause economical disadvantages. In order to prevent the stop position of the bucket 23 from varying, hitherto, the operator keeps the engine speed constant, or controls the stop position of the bucket 23 in a very sensitive manner, which causes the operator to be very tired. Such operator's fatigue is another problem inherent in the conventional bucket leveler device.

SUMMARY OF THE INVENTION

Under such circumstances, the present invention is completed. It is an object of the present invention to provide an apparatus for compensating a stop position of a bucket, the apparatus being employed in a bucket leveler device so as to automatically compensate the stop position of the bucket to make it possible to keep the bucket substantially horizontal even when the engine is operated at any speed (engine speed), whereby the operator's fatigue is lessened to improve the operation in efficiency, and wear parts such as the cutting edge of the bucket are prevented from being unevenly worn to produce a large economical effect.

The above object of the present invention is accomplished by providing: In an apparatus for compensating a stop position of a bucket, employed in a bucket leveler device for control said bucket to keep it horizontal, in which bucket leveler device a bucket cylinder unit is extended by a predetermined length so as to turn on a limit switch which in turn issues an ON signal to a relay for energizing a leveler solenoid to turn on said relay so that said leveler solenoid is energized and a bucket control lever is automatically returned to its neutral position by the thus energized leveler solenoid: the improvement wherein: extending/retracting speeds of said bucket cylinder unit is detected by a detecting means; a necessary time lag is established on the basis of a signal issued from said detecting means; and, after collapse of a period of said time lag, said relay for energizing said leveler solenoid is tuned on and kept "on" until said limit switch is turned off.

In addition, according to the present invention, there is further provided: The apparatus for compensating the stop position of said bucket, wherein: said signal issued from said detecting means corresponds to an engine speed detected by means of an engine speed sensor; and said time lag is so established as to increase as said engine speed decreases, and decrease as said engine speed increases.

The above and many other advantages, features and additional objects of the present invention will become manifest to those versed in the art upon making reference to the following detailed description and accompanying drawings in which preferred structural embodiments incorporating the principles of the present invention are shown by way of illustrative examples.

DESCRIPTION OF THE PREFERRED EMBODIMENTS

Hereinbelow, embodiments of the present invention will be described in detail with reference to FIGS. 1 to 6 of the accompanying drawings.

Figure 1:
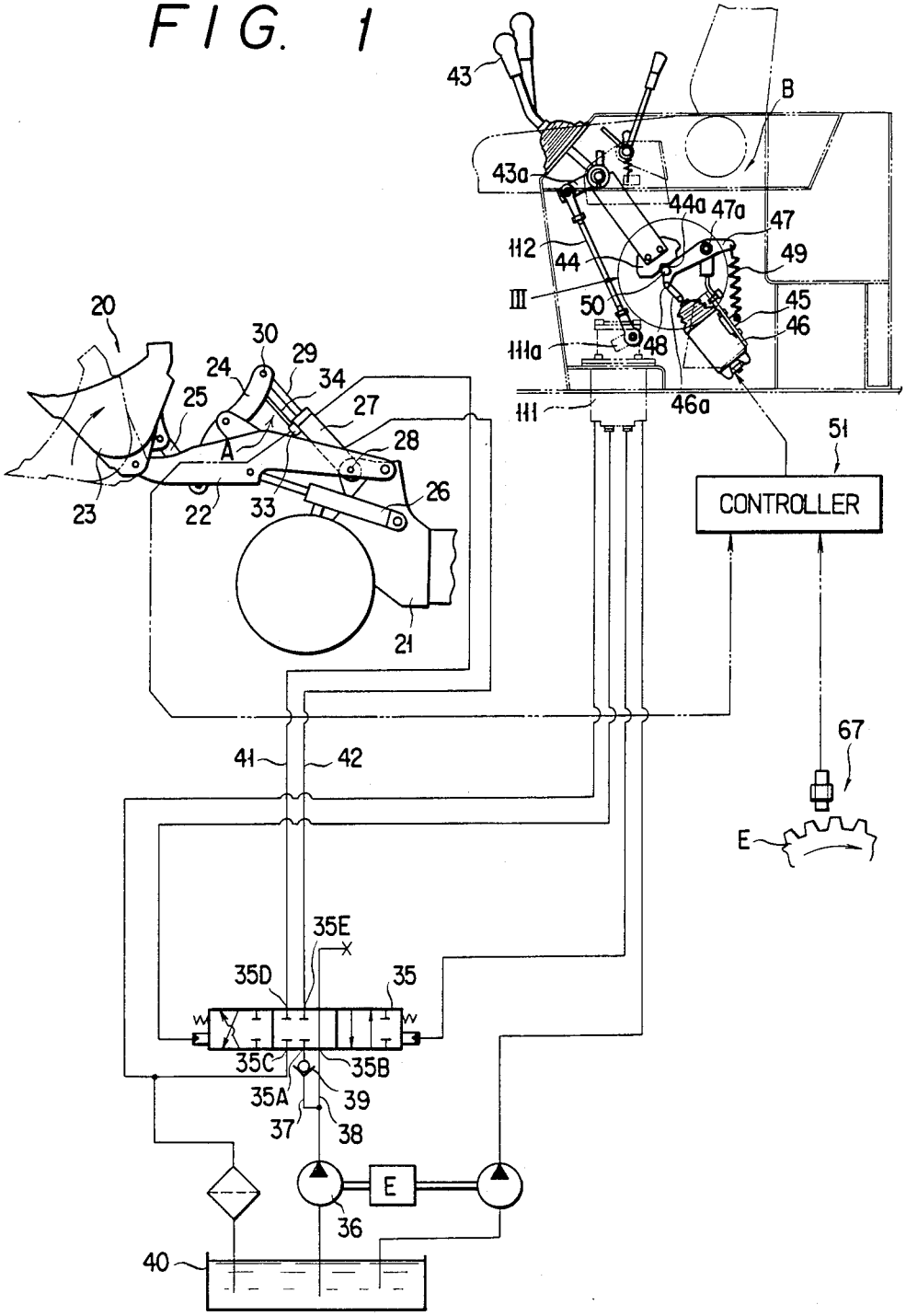
FIG. 1 is a schematic view of an embodiment of the present invention.
Figure 2:
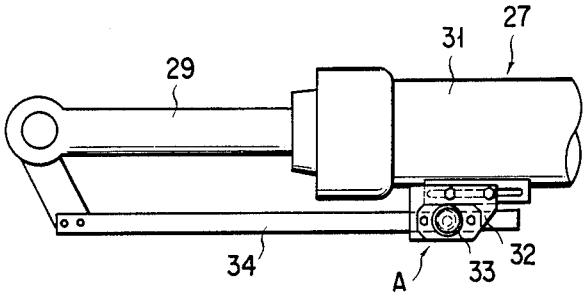
FIG. 2 is an enlarged side view of an essential part of the bucket position detecting mechanism employed in the embodiment of the present invention shown in FIG. 1.
Figure 3:
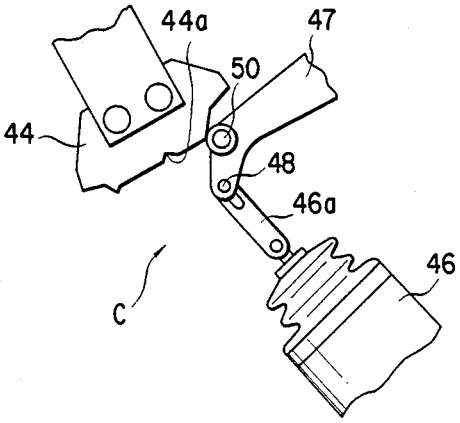
FIG. 3 is a partially enlarged view of a part of the embodiment of the present invention shown in FIG. 1, encircles with a circle 111.

FIG. 1 is a schematic view of an embodiment of the present invention, in which: the reference numeral 20 denotes a loader such as a tractor shovel and the like. The loader 20 is provided with a boom 22 pivotally mounted on a body 21 of the loader 20. In a front-end portion of the boom 22 is vertically swingably mounted a bucket 23. A lever 24 is pivotally connected to the boom 22. A front-end portion of the lever 24 is connected with the bucket 23 through a link 25.

In the body 21 of the loader 20 is provided a boom cylinder 26 for swingably driving the boom 22 in a vertical plane. A base portion of a bucket cylinder unit 27 is pivotally connected to the body 21 of the loader 20 through a pivot pin 28. A piston rod of the bucket cylinder unit 17 is pivotally connected to a base portion of the lever 24 through a pivot pin 30. As is clearly shown in FIG. 2, a limit switch 33 is mounted on a cylinder 21 of the bucket cylinder unit 27 through a switch holer 32. On the other hand, a detecting element 34 is provided in the piston rod 29 of the bucket cylinder unit 27. A signal issuing portion "A" of the embodiment of the present invention shown in FIG. 1 is constructed of these components.

In the drawings, particularly in FIG. 1: the reference numeral 35 denotes a bucket control valve. Ports 35A, 35B of the bucket control valve 35 are connected to a delivery ports of an oil pump 36 through oil passages 37, 38, the oil pump being driven by an engine "E" of the loader 20. A check valve 39 is provided in the oil passage 37. An oil reservoir port 35C of the bucket control valve 35 is communicated with a oil reservoir 40.

On the other hand, other ports 35D and 35E of the bucket control valve 35 are connected to a rod-side pressure chamber (not shown) and a bottom-side pressure chamber (not shown) of the bucket cylinder unit 27 through other passages 41 and 42 respectively, these pressure chambers of the bucket cylinder unit 27 are separated from each other by means of a piston of the bucket cylinder unit 27 so as to be positioned in opposite sides of the bucket cylinder unit 27.

The bucket cylinder unit 27 is extended/retracted as the oil pump 36 delivers the oil. Since the delivery of the oil pump 36 is proportional to the engine speed, the extending/retracting speed of the bucket cylinder unit 27 is also proportional to the engine speed.

In FIG. 1, the reference character "B" denotes a bucket control lever return mechanism portion in which: a guide plate 44 is fixedly mounted on a lower-end portion of a bucket control lever 43; and a leveler solenoid 46 is fixedly mounted on a frame 45 of the body 21 of the loader 20. A lever 47 is pivotally mounted on the frame 45 through a pivot pin 47*a*. An end portion of the lever 47 is connected to a movable member 46*a* of the leveler solenoid 46 through a pivot pin 48, while the other end portion of the lever 47 is connected to a tension spring 49 interposed between such other end portion of the lever 47 and the frame 45. As is clearly shown in FIG. 3, a roller 50 is pivotally mounted on the lever 47 to form a detent mechanism "C" for the lever 47. The roller 50 is pressed against a concave portion 44*a* of the guide plate 44 under the influence of a resilient force exerted by the tension spring 49, so that the roller 50 is forcibly held in the concave portion 44*a* of the guide plate 44.

The bucket contrl lever 43 is pivotally mounted on the frame 45 of the body 21 of the loader 20 through a pivot pin. In the drawings, the reference numeral 111 denotes a pilot valve for hydraulically controlling the bucket control valve 35. A lever 111*a* extending from the pilot valve 111 is connected to a lever 43*a* through a rod 112, the lever 43*a* being fixed to the bucket control lever 43.

Incorporated in the pilot valve 111 is a return spring (not shown) for returning the bucket control lever 43 to its neutral position.

In case that the bucket control lever 43 is moved to its tilt position so that, under the influence of the resilient force or tensile force exerted by the tension spring 49, the roller 50 is forcibly inserted into the concave portion 44*a* of the guide plate 44 mounted in the lower-end portion of the lever 43, the bucket control lever 43 is held in its tilt position unless the leveler solenoid 46 is actuated against the resilient force of the return spring (not shown) of the pilot valve 111 so as to disengage the roller 50 from the concave portion 44*a* of the guide plate 44.

On the other hand, by operating the bucket control lever 43, it is possible to operate an inner spool of the pilot valve 111. When the spool of the pilot valve 111 is operated, a spool of the bucket control valve 35 is hydraulically moved to its tilt position to permit the oil to flow through the oil passage 42, whereby the bucket cylinder unit 27 is extended to move the bucket 23 upward.

Figure 4:
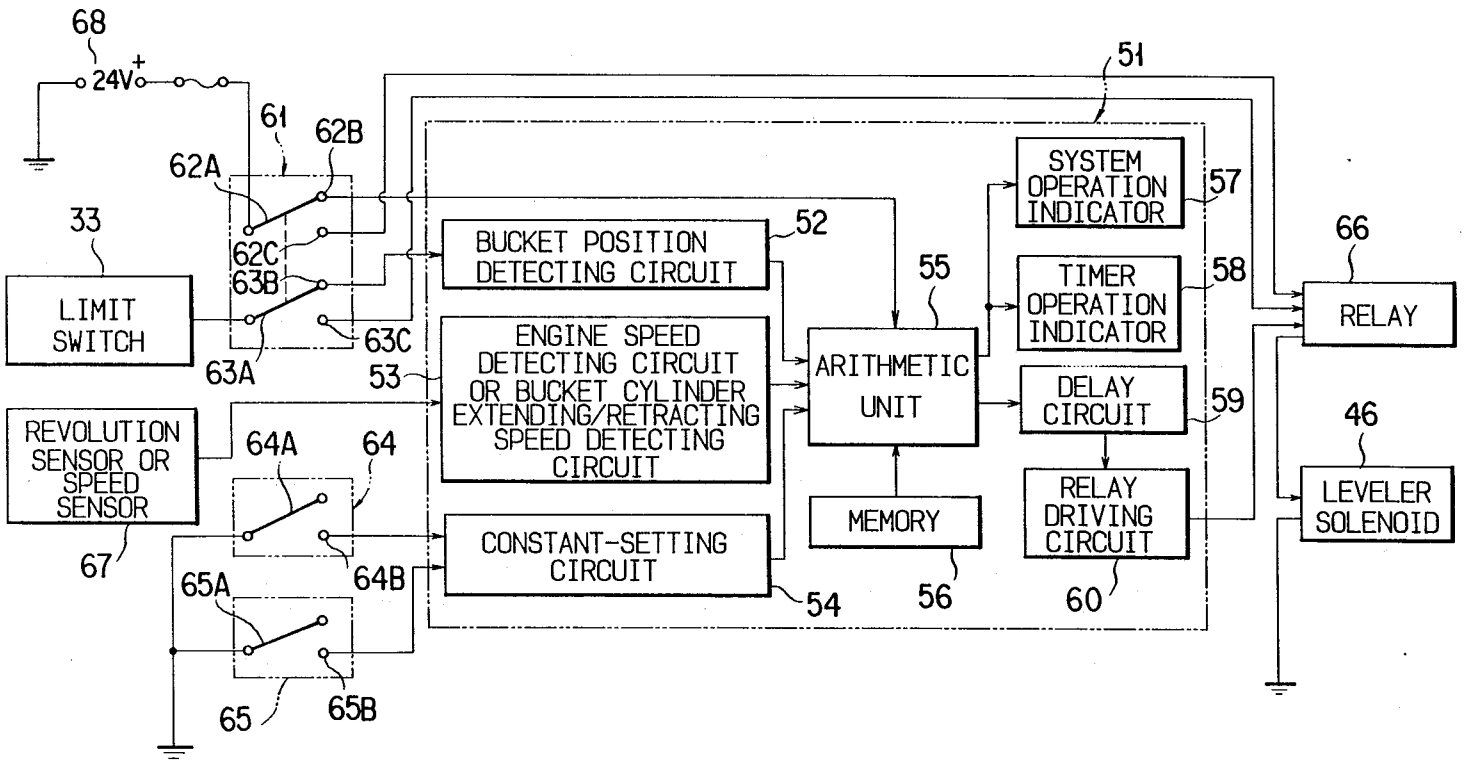
FIG. 4 is a block diagram of a control mechanism employed in the apparatus of the present invention for compensating the stop position of the bucket.

In FIG. 1, the reference numeral 51 denotes a controller. As shown in FIG. 4, the controller 51 comprises: a bucket position detecting circuit 52; an engine speed detecting circuit 53; a constant-setting circuit 54 for setting a constant; an arithmetic unit 55; a memory 56; a system operation indicator 57; a timer operation indicator 58; a delay circuit 59; and a relay driving circuit 60.

All the output terminals of the bucket position detecting circuit 52, engine speed detecting circuit 53, constant-setting circuit 54 and the memory 56 are connected to input terminals of the arithmetic unit 55. On the other hand, input terminals of the system operation indicator 57 and the timer operation indicator 58 are connected to output terminals of the arithmetic unit 55. The output terminals of the arithmetic unit 55 are connected to input terminals of the relay driving circuit 60 through the delay circuit 59.

In FIG. 4: the reference numeral 61 denotes a system on/off switch; 64 and 65 change-over switches for setting a plurality of operating modes through ON-OFF combination of these switches, the modes being determined on the basis of a variable relationship between the engine speed and the time lag produced in the bucket leveler device; 66 a relay for energizing the leveler solenoid 46; and 67 a speed sensor for detecting the engine speed of the engine "E".

The system on/off switch 61 is provided with a pair of contact segments 62 A, 63A and a pair of contact points 62B, 63B together with another pair of contact points 62C, 63C, which contact points cooperate with the contact segments 62A, 63A in operation. The contact segment 62A is connected to an electric power source 68 (DC 24 V). The remaining contact segment 63A is connected to the limit switch 33. On the other hand, the contact point 62B is connected to the input terminals of the arithmetic unit 55. The contact point 63B is connected to the input terminals of the bucket position detecting circuit 52. The remaining contact points 62C, 63C are connected to the relay 66. Contact segments 64A and 65A of the change-over switches 64 and 65 are grounded, respectively. The remaining contact points 64B and 65B of the change-over switches 64 and 65 are connected to the input terminals of the constant-setting circuit 54, respectively. On the other hand, the engine speed sensor 67 is connected to the input terminals of the engine speed detecting circuit 53.

The output terminals of the relay driving circuit 60 are connected to the relay 66, while the output terminals of the relay 66 are connected to the leveler solenoid 46.

Now, the operation of the apparatus of the present invention for compensating the stop position of the bucket will be hereinbelow described with reference to the flowchart shown in FIG. 5.

In a step 100, the system on/off switch 61 is turned on in a condition in which the loader 20 is driven. Then, in a step 101, the signal issued from the speed sensor 67 is constantly measured. At this time, in order to prevent abnormal signals from being employed in operation, the signal or engine speed thus measured is compensated so as to provide a compensated engine speed. In a step 102, the operator selects a level number of such compensated engine speed on the basis of the following table:

| Engine Speed | | |
|---|---|---|
| Level No. | Speed Range (rpm) | Time Lag Bi (sec) |
| 1 | 0 to $n_1$ | $B_1$ |
| 2 | $n_1$ to $n_2$ | $B_2$ |
| 3 | $n_2$ to $n_3$ | $B_3$ |
| . | . | . |
| . | . | . |
| . | . | . |
| N | $n_{N-1}$ to $n_N$ | $B_N$ |

$n_N$: Engine speed in a high idling operation of the engine.

Figure 5:
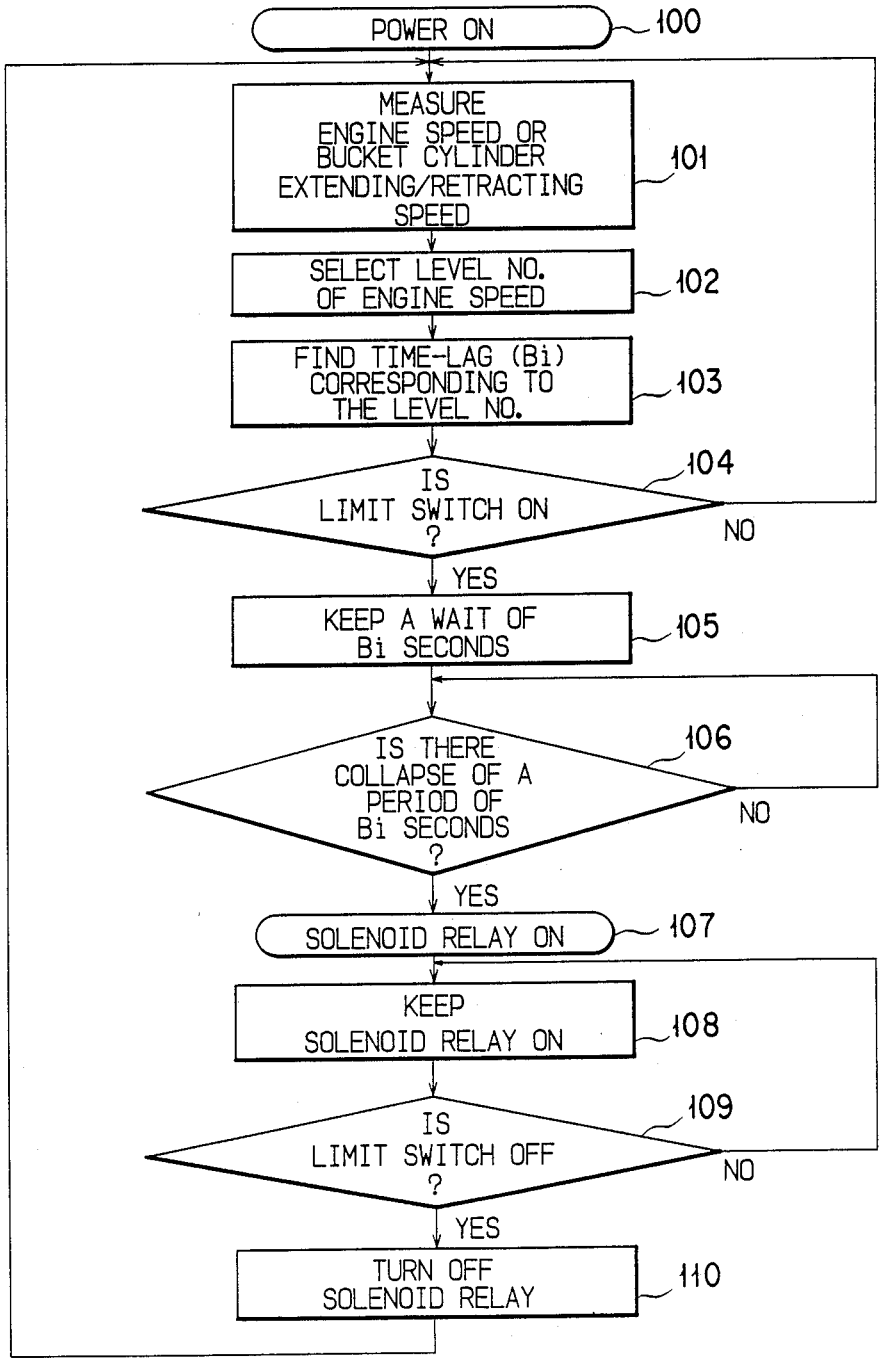
FIG. 5 is a flowchart illustrating the operation of the apparatus of the present invention for compensating the stop position of the bucket.

After selection of the level number of the engine speed, in a step 103 shown in FIG. 5, a time lag Bi corresponding to the above level number is determined.

In a step 104, it is decided whether or not the limit switch 33 is turned on to issue a signal. In case that the limit switch 33 is not turned on so that any signal is not issued from the limit switch 33, the programmed process illustrated in the flowchart shown in FIG. 5 returns to the step 101 in which the engine speed is measured again. So long as any signal is not issued from the limit switch 33, the above return process is repeated so that the time lage Bi depending on the engine speed is constantly renewed.

At this time, when the bucket cylinder unit 27 is extended by a predetermined length so that the limit switch 33 is turned on, the relay 66 for energizing the leveler solenoid 46 is turned on after collapse of a period of the thus renewed time lag Bi in a steps 105, 106 and 107 so that the bucket control lever 43 returns to its neutral position after the collapse of such period of the renewed time lag Bi.

In a step 108, the relay 66 is kept "on" until the limit switch 33 is turned off. In a step 109, when the limit switch 33 is turned off, the relay 66 is turned off. As a result, in a step 110, the leveler solenoid 46 is de-energized.

As is clear from the above description, the bucket 23 is lowered by lowering the boom 22 for performing its shoveling action of the next cycle, and is constantly stopped on the ground after collapse of the time lag Bi. An amount of the time lag Bi is so set as to increase as the engine speed decreases, and decrease as the engine speed increases, whereby the bucket 23 is constantly stopped at a substantially predetermined horizontal position regardless of variation of the engine speed (the predetermined horizontal corresponding to the bucket stop position at a time when the engine speed is maximum).

In case that the controller 51 fails, it is possible to keep the conventional functions of the bucket leveler device alive by operating the system on/off switch 61. The system operation indicator 57 indicates the fact that the controller 51 is alive. On the other hand, the timer operation indicator 58 indicates the fact that the delay circuit 59 is operated.

In the above embodiment of the present invention shown in FIGS. 1 to 5, the change-over switches 64, 65 are provided to make it possible to vary the amount of the time lag Bi being preset. Consequently, it is possible to adapt the bucket leveler device of the present invention to various types of the loaders through only operations of the change-over switches 64, 65.

In addition, in the above embodiment of the present invention, the speed sensor 67 for detecting the engine speed proportional to the extending/retracting speed of the bucket cylinder unit 27 serves also as a means for detecting the extending/retracting speed of the bucket cylinder unit 27. However, it is also possible to directly detect the extending/retracting speed of the bucket cylinder unit 27 so as to issue a signal to the controller 51.

Figure 6:
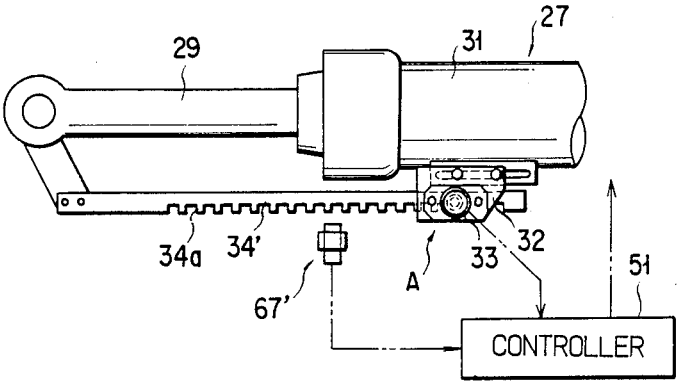
FIG. 6 is a partially enlarged view of an essential part of the bucket position detecting mechanism provided with means for detecting the extending/retracting speed of the bucket cylinder unit employed in another embodiment of the present invention.

In FIG. 6, there is shown a second embodiment of the present invention which is a unit for directly detecting the extending/retracting speed of the bucket cylinder unit 27. Namely, in this unit of the second embodiment of the present invention, there is provided a detecting element 34' interposed between a front end of the piston rod 29 of the bucket cylinder unit 27 and the cylinder 31 of the same. A plurality of concave/convex portions are regularly arranged in a portion of the detecting element 34'. When the bucket cylinder unit 27 is extended/retracted, a number of the concave/convex portions having passed through a speed sensor 67' for a predetermined period of time is detected by such speed sensor 67' to determine the extending/retracting speed of the bucket cylinder unit 27. In this second embodiment of the present invention, it is also clear that the time lag Bi corresponding to the thus detected extending/retracting speed of the bucket cylinder unit 27 is read out of the memory 56 of the controller 51.

In operation, the second embodiment of the present invention operates according to the same flowchart as that of the first embodiment of the present invention shown in FIG. 5.

As described above in detail, by the use of the apparatus of the present invention for compensating the stop position of the bucket, employed in the bucket leveler device, it is possible to eliminate the operator's additional actions previously required to keep the stop position of the bucket constant. As a result, in contrast with the conventional operator's actions, the operator of the apparatus of the present invention is not required to constantly control the engine speed by controlling an accelerator pedal of the loader such as the tractor shovel and the like so that his fatigue is considerably lessened to make it possible to improve his actions in efficiency and accuracy, which leads to prevention of uneven wear of the wear parts such as the cutting edge of the bucket, whereby a large economical effect is obtained.

I claim:

1. In an apparatus for compensating a stop position of a bucket of a tractor shovel, employed in a bucket leveler device for controlling said bucket to keep it in a horizontal position, said bucket leveler device including a bucket control lever for tilting, dumping and stopping said bucket by the actin of a bucket cylinder unit actuated by hydraulic fluid delivered from an oil pump driven by an engine mounted on said tractor shovel, said bucket cylinder unit being extended by a predetermined length so as to turn on a limit switch which in turn issues an ON signal to a relay for energizing a leveler solenoid associated with said bucket leveler device to turn on said relay so that said leveler solenoid is energized and said bucket control lever being automatically returned to a neutral position, where said bucket is stopped in the horizontal position, by the thus energized leveler solenoid; the improvement wherein: extending/retracting speeds of said bucket cylinder unit are detected by a detecting means; a necessary time lag is established on the basis of a signal issued from said detecting means; and, after collapse of a period of said time lag, said relay for energizing said leveler solenoid is turned on and kept "on" until said limit switch is turned off by the predetermined extension of said bucket cylinder unit.

2. The apparatus for compensating the stop position of the bucket as set forth in claim 1, wherein: said signal issued from said detecting means corresponds to an engine speed detected by means of an engine speed sensor, said detecting means and said engine speed sensor being connected to controller means for determining said time lag; and said time lag is so set as to increase as said engine speed decreases, and decrease as said engine speed increases.

* * * * *